US006996355B2

(12) United States Patent
Watanabe

(10) Patent No.: US 6,996,355 B2
(45) Date of Patent: Feb. 7, 2006

(54) IMAGE FORMATION APPARATUS HAVING CHARGING MEANS AND DEVELOPING AGENT CHARGING MEANS

(75) Inventor: Yasunari Watanabe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 140 days.

(21) Appl. No.: 10/685,465

(22) Filed: Oct. 16, 2003

(65) Prior Publication Data

US 2004/0086297 A1 May 6, 2004

(30) Foreign Application Priority Data

Oct. 31, 2002 (JP) ..... 2002-318859
Oct. 7, 2003 (JP) ..... 2003-348457

(51) Int. Cl.
*G03G 21/00* (2006.01)

(52) U.S. Cl. ..... 399/129; 399/149; 399/150

(58) Field of Classification Search ..... 399/127, 399/129, 148, 149, 150
See application file for complete search history.

(56) References Cited

U.S. PATENT DOCUMENTS 6,345,162 B1 * 2/2002 Ozawa et al. ..... 399/61
6,421,512 B2 7/2002 Watanabe et al. ..... 399/149
6,459,872 B1 10/2002 Komiya et al. ..... 399/149
6,477,342 B2 11/2002 Komiya et al. ..... 399/98
6,603,941 B2 * 8/2003 Watanabe et al. ..... 399/129
6,611,668 B2 * 8/2003 Watanabe et al. ..... 399/129
6,807,384 B2 * 10/2004 Okubo et al. ..... 399/50
2003/0077088 A1 4/2003 Adachi et al. ..... 399/129

* cited by examiner

*Primary Examiner*—Hoan Tran
(74) *Attorney, Agent, or Firm*—Fitzpatrick, Cella, Harper & Scinto

(57) ABSTRACT

An image formation apparatus has developing agent charging device situated downstream in the direction of motion of a photosensitive drum from a transfer roller and upstream from a charging roller, for charging residual developing agent remaining on the photosensitive drum. Applying AC voltage to the charging roller is started before a portion on the face of the photosensitive drum where application of voltage to the developing agent charging device has started reaches a position of coming into contact with the charging roller, and applying AC voltage to the charging device is ended after the portion on the face of the photosensitive drum where application of voltage to the developing agent charging device has ended reaches a position of coming into contact with the charging roller. This configuration prevents adhesion of developing agent to the photosensitive drum and charging roller, avoids resultant substandard images, and provides high-quality images for prolonged periods.

12 Claims, 3 Drawing Sheets

IMAGE FORMATION APPARATUS HAVING CHARGING MEANS AND DEVELOPING AGENT CHARGING MEANS

BACKGROUND OF THE INVENTION

1. Field of the Invention

The present invention relates to an image formation apparatus having charging means for coming into contact with and charging an image carrying member, and developing agent charging means for charging a developing agent on the image carrying member.

2. Description of the Related Art

Hitherto, there have been known image formation apparatuses such as photocopiers, printers, facsimile apparatuses, and so forth, using transfer-type electrophotography or electrostatic recording. Electrophotography image formation apparatuses comprise: a photosensitive member serving as an image carrying member which is normally a rotating drum; charging means for uniformly charging the photosensitive member to a predetermined polarity and potential (i.e., performing a charging step); electrostatic latent image formation means, i.e., exposing means for forming an electrostatic latent image on the charged photosensitive member (i.e., performing an exposing step); developing means for manifesting the electrostatic latent image formed on the photosensitive member with a developing agent (toner) to form a developing agent image (toner image) on the photosensitive member (i.e., performing a developing step); transfer means for transferring the toner image from the surface of the photosensitive member onto a recording medium such as paper or the like (i.e., performing a transfer step); cleaning means for removing any residual toner remaining on the photosensitive member following the transfer step to clean the surface of the photosensitive member (i.e., performing a cleaning step); fixing means for fixing the toner image on the recording medium (i.e., performing a fixing step); and so forth. The photosensitive member is repeatedly used in the image formation processing made up of the steps for charging, exposing, developing, transfer, and cleaning.

Following the toner image having been transferred onto the recording medium, the toner remaining on the surface of the photosensitive member is removed therefrom by a cleaning device serving as cleaning means. The removed toner is recovered in the cleaning device and stored as waste toner. However, it should be noted that the amount of waste toner generated should be as little as possible, from the perspective of the environment and effective use of resources. This has led to development of a known image formation apparatus wherein the waste toner collected in the cleaning device is returned to the developing means, and re-used there.

There are also known cleaner-less type image formation apparatuses wherein the cleaning device has been done away with. With cleaner-less type image formation apparatuses, the toner remaining on the photosensitive member following the transferring process is removed by the developing means, and the removed toner is recovered within the developing means and re-used there.

The cleaner-less type image formation apparatuses which clean the toner remaining on the photosensitive member in this way perform cleaning simultaneously with the process for developing the electrostatic latent images with the developing means, which we will refer to as "simultaneous developing and cleaning".

Simultaneous developing and cleaning is a method for recovering the residual toner in the developing means, that is, the transfer-residual developing agent (transfer-residual toner) remaining on the photosensitive member without being transferred onto the recording medium by the transfer means, at a subsequent developing step.

That is to say, the photosensitive member with toner remaining continues to be charged by the charging means, an electrostatic latent image is formed on the surface of the photosensitive member by the exposing means, and an electrostatic latent image is developed thereupon by the developing means. Then, simultaneously with the electrostatic latent image being developed by the developing means, the residual toner at the unexposed portions without being developed is recovered by a bias for removing fogging, which is a fogging-removal potential difference Vback, more specifically, a potential difference between the DC voltage applied to the developing means and the surface potential of the photosensitive member.

According to this method, the residual toner is recovered by the developing means, and re-used in subsequent developing processing. Accordingly, there is no waste toner generated, also doing away with troublesome maintenance for recovering the waste toner. Further, the image formation apparatus can be reduced in size since there is no need for the cleaning device.

However, even in arrangements wherein the charging means is contact-charging means wherein the photosensitive member is charged by the contact means coming into contact with the surface of the photosensitive member, of the residual toner on the photosensitive member, the toner having a charge with opposite polarity to the regular polarity of the toner (i.e., inverted toner) adheres to the contact charging means in particular, at the time of the residual toner on the photosensitive member passing through a contact nip portion (charging portion) between the photosensitive member and the contact charging means. Accordingly, the contact charging means is contaminated by the toner beyond a permissible level, to the extent that the changing means cannot charge the photosensitive member sufficiently.

Now, a cleaner-less type image formation apparatus such as described above has been proposed wherein adhesion of residual toner to the charging means, in the event that the charging means is contact charging means, is prevented, with substandard charging and images being done away with by the developing means effectively collecting the residual toner, and further wherein the advantages of the cleaner-less method are maximized.

Such an image formation apparatus comprises first developing agent charging means positioned downstream in the direction of rotation of the photosensitive member from the transfer means but upstream from the charging means for forming the electrostatic latent image, for charging the residual developing agent on the photosensitive member, and second developing agent charging means positioned downstream form the first developing agent charging means but upstream form the charging means, for successively charging the residual developing agent on the photosensitive member.

The first developing agent charging means charges the residual developing agent, i.e., the developing agent remaining on the photosensitive member without being transferred by the transfer device, to a polarity opposite to the regular polarity of the developing agent (toner). Next, the second developing agent charging means charges the developing agent which has been charged to a polarity opposite to the regular polarity of the residual developing agent (toner), to the regular polarity. Subsequently, the charging means charges the photosensitive member, and at the same time uniformly charges the residual toner as appropriate.

Due to this, adhesion of the residual toner to the charging means is prevented, and the developing means can effectively recover the residual developing agent, thereby doing away with substandard charging and images, and further maximizing the advantages of the cleaner-less method.

However, there have been the following problems in non-steady operation states, such as upon start-up or closing down of the image formation apparatus.

First, in the event of bringing the first or second developing agent charging means into contact with the photosensitive member, there is some toner which remains on the developing agent charging means. This toner loses its force to remain at the nip between the photosensitive member and the developing agent charging means in the instant that bias is applied to the developing agent charging means or in the instant that application of bias is stopped, and accordingly is discharged onto the photosensitive member. The amount of charge of such toner is not controlled by the developing agent charging means, the toner adheres to the charging means at the time of being transferred to the charging means according with the movement of the photosensitive member, and accordingly leads to substandard charging or substandard images.

Second, the charging potential on the photosensitive member is unstable at the time of starting up or ending image formation actions, and a predictable potential is not available. Particularly, in the event that magnetic brushes or the like are used for the developing means, toner may adhere to the photosensitive member depending on the potential thereof even in the event that there is no supply of electric power to the developing means for example, or in the event that two-component developing is being employed, the carrier may adhere to the photosensitive member depending on the potential thereof, leading to substandard images.

SUMMARY OF THE INVENTION

It is an object of the present invention to avoid substandard images, and maintain high-quality image formation over prolonged periods of time.

It is another object of the present invention to prevent contamination of the charging means due to developing agent adhering to the charging means.

It is another object of the present invention to do away with substandard charging of the image carrying member, and realizing uniform surface potential.

It is another object of the present invention to improve recovery of the developing agent at the developing means or transfer means.

In order to achieve the above objects, an image formation apparatus comprises: an image carrying member; charging means for being applied with a voltage including an AC voltage component and coming into contact with the face of the image carrying member so as to charge the image carrying member; developing means for visualizing an electrostatic latent image formed on the image carrying member into a developing agent image with a developing agent; transfer means for transferring the developing agent image onto a transfer member; and developing agent charging means for charging developing agent remaining on the image carrying member following the transfer; wherein the developing agent charging means is upstream in the direction of motion of image carrying member as to the charging means and downstream from the transfer means; and wherein application of the AC voltage to the charging means is started before a portion on the image carrying means, where application of voltage to the developing agent charging means has started, reaches a position of coming into contact with the charging means; and wherein ending of application of the AC voltage to the charging means ends after before a portion on the image carrying means, where application of voltage to the developing agent charging means has ended, reaches a position of coming into contact with the charging means.

Further objects, features and advantages of the present invention will become apparent from the following description of the preferred embodiments with reference to the attached drawings.

DESCRIPTION OF THE PREFERRED EMBODIMENTS

First Embodiment

The following is a detailed description of the image formation apparatus according to the present invention, with reference to the drawings.

Figure 1:
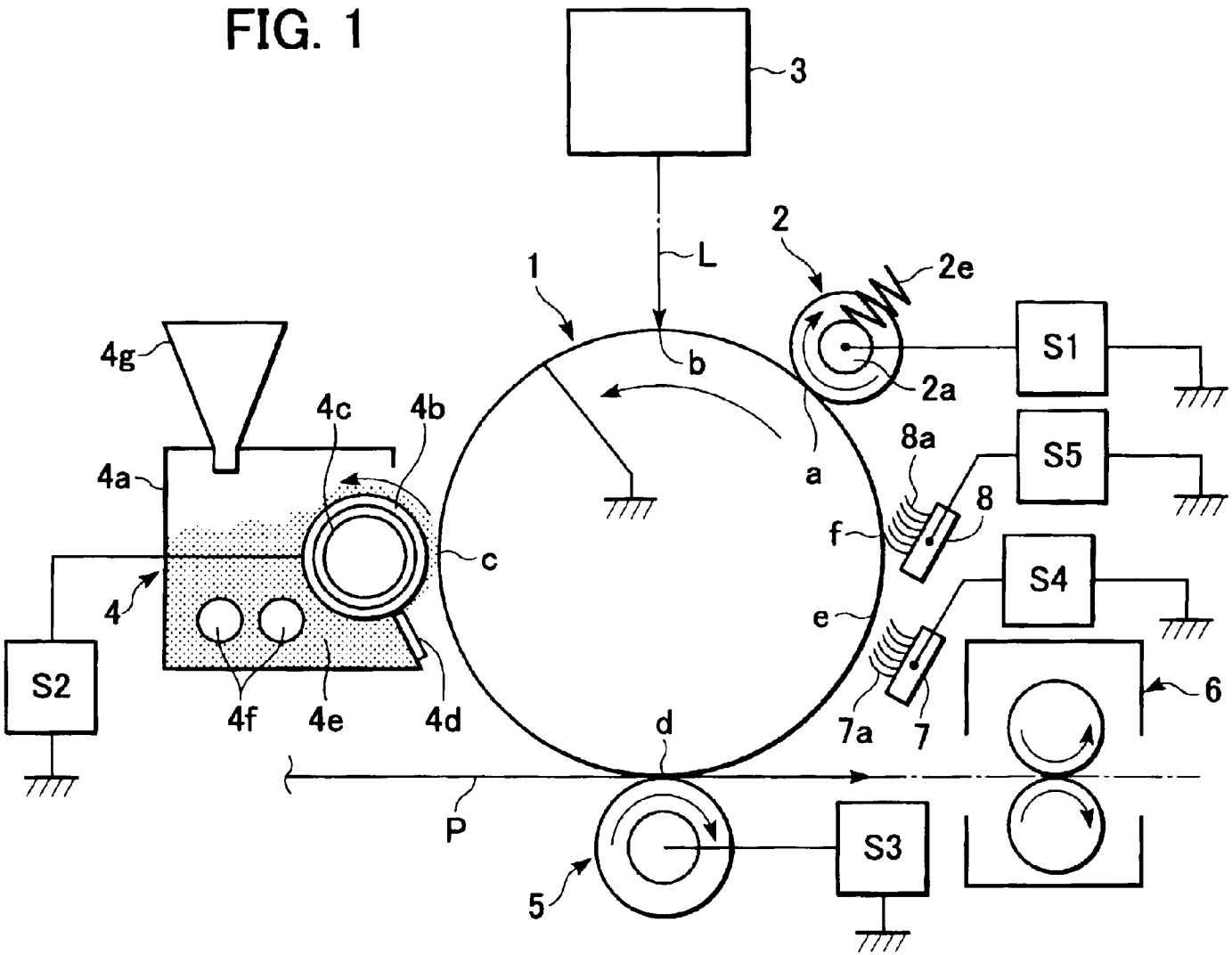
FIG. 1 is a schematic configuration diagram illustrating an example of an image formation apparatus according to the present invention.

FIG. 1 is a schematic configuration diagram illustrating an example of an image formation apparatus according to the present invention. The image formation apparatus according to the present invention is a laser beam printer which employs the transfer-type electrophotography process, contact charging, inversion developing, and a cleaner-less system which performs simultaneous developing and cleaning with a developing device serving as the developing means, and can handle up to A3 size PPC (plain paper copier) sheets.

First, the overall configuration of the printer of the image formation apparatus according to the present invention will be described. The primary components described below are the: a) image carrying member, b) charging means, c) electrostatic latent image formation means, d) developing means, and e) transfer and fixing means.

a) Image carrying member: A rotating drum electrophotography photosensitive member 1 (hereafter referred to as "photosensitive drum") is provided as the image carrying member. This photosensitive drum 1 is a negative-charging organic photo-conductive (OPC) drum, with an external diameter of 50 mm, rotationally driven in the counter-clockwise direction indicated by the arrow at a process speed (circumferential speed) of 100 mm/sec on a center shaft.

Figure 2:
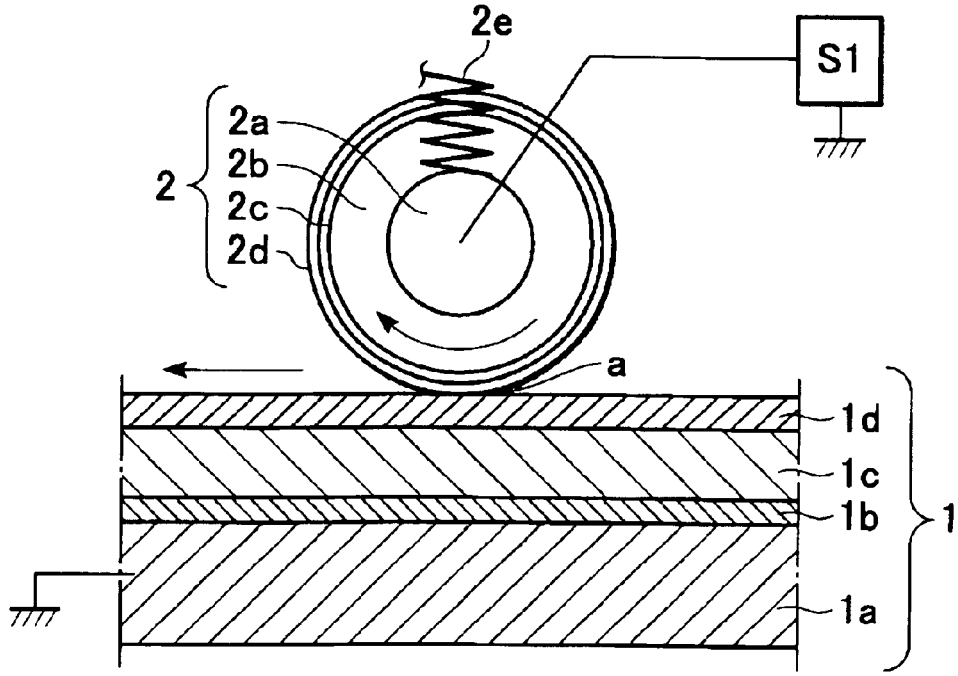
FIG. 2 is a cross-sectional diagram illustrating a contact portion between an example of the charging means and image-carrying member according to the present invention.

The photosensitive drum 1 has, as shown in the model illustration of the layer formation in FIG. 2, a layered structure of an aluminum cylinder (electroconductive drum base) 1*a*, and upon the surface thereof are layered the three layers of: a base layer 1*b* for suppressing light interference and improving the adhesion of the upper layer; a photoinduced charge generating layer 1*c*; and a charge transporting layer 1*d* having a thickness of t μm; in that order.

b) Charging means: The contact charging method is used with the present embodiment for the charging means 2, for uniformly charging the perimeter surface of the photosensitive drum 1 with a predetermined polarity and potential, with a roller charger (hereafter referred to as "charging roller") provided as the contact charging member. Voltage of predetermined conditions is applied to the charging roller 2, so that the surface of the photosensitive drum 1 is uniformly charged to a negative polarity. The portion of contact "a" between the photosensitive drum 1 and the charging roller 2 is the charging portion (charging nip portion).

The length of the charging roller 2 in the longitudinal direction for charging the face of the photosensitive drum 1 is 320 mm, and has a three-layer structure as shown in the model illustration of the layer formation in FIG. 2, of a lower layer 2*b*, an intermediate layer 2*c*, and a surface 2*d*, around a core (supporting member) 2*a*, in that order. The lower layer 2*b* is a foam sponge layer for reducing charging noise, the intermediate layer 2*c* is an electroconductive layer for obtaining a uniform resistance for the entire charging roller 2, and the surface 2*d* is a protective layer for preventing leaking even in the event that there are defects on the photosensitive drum 1 such as pinholes or the like.

More specifically, the specifications of the charging roller 2 are as described below.

Core 2*a*: stainless steel rod, 6 mm in diameter

Lower layer 2*b*: EPDM (Ethylene Propylene Diene Monomer) foam with carbon dispersed, relative gravity of 0.5 g/cm$^3$, volume resistance of $10^3$ Ω·cm, thickness of 3.0 mm, and length of 320 mm Intermediate layer 2*c*: NBR rubber with carbon dispersed, volume resistance of $10^3$ Ω·CM, thickness of 700 μm Surface layer 2*d*: fluorine compound resin with tin oxide and carbon dispersed, volume resistance of $10^8$ Ω·cm, surface roughness (ten-point average surface roughness under JIS standards) of 1.5 μm, thickness of 10 μm The charging roller 2 formed thus has both ends of the core 2*a* rotatably held by bearings and pressed against the surface of the photosensitive drum 1 with a predetermined amount of pressing force by pressing springs 2*e*, so as to rotate following the rotations of the photosensitive drum 1.

Applying a predetermined oscillating voltage, wherein an AC voltage of a predetermined frequency has been superimposed on a DC voltage from the electric power source S1, to the charging roller 2 via the core 2*a*, charges the circumferential face of the rotating photosensitive drum 1 to a predetermined potential.

c) Electrostatic latent image formation means: As a specific configuration, a laser scanner is used as means for forming an electrostatic latent image on the surface of the photosensitive drum 1 which has been subjected to charging. The laser scanner 3 is used to perform laser scanning exposure L (image exposure) at an exposure position "b" on the surface of the rotating photosensitive drum 1 which has been subjected to uniform charging, by outputting laser beams which have been modulated corresponding to image signals transmitted to the printer side from a host side such as an unshown image reading device or the like. The potential of the portions of the surface of the photosensitive drum 1 irradiated by the laser beam in the laser scanning exposure L drops, so an electrostatic latent image corresponding to the image information is consecutively formed on the surface of the rotating photosensitive drum 1 subjected to scanning exposure.

d) Developing means: With the present example, an inversion developing device employing a two-component magnetic brush developing method, is used as developing means 4 for supplying the developing agent (toner) to the electrostatic latent image on the photosensitive drum 1 and visualizing the electrostatic latent image.

The developing device 4 has a developing container 4*a* and a non-magnetic developing sleeve 4*b*, with the developing sleeve 4*b* being rotatably disposed within the developing container 4*a* with a part of the outer circumference thereof externally exposed. A magnetic roller 4*c* non-rotatably fixed is provided within the developing sleeve 4*b*. Also provided are a developing agent coating blade 4*d*, the two-component developing agent 4*e* stored within the developing container 4*a*, developing agent stirring members 4*f* disposed at the bottom of the developing container 4*a*, and a toner hopper 4*g* for storing toner to be supplied.

The two-component developing agent 4*e* within the developing container 4*a* is a mixture of toner and a magnetic carrier, and is stirred by the developing agent stirring members 4*f*. In the present embodiment, the resistance of the magnetic carrier is approximately $10^{13}$ Ω·cm, and the grain diameter is approximately 40 μm. The toner is negatively charged by friction with the magnetic carrier (negative toner).

The developing sleeve 4*b* is disposed facing the photosensitive drum 1 at a close distance, with a minimal gap distance (called "S-D gap") of 350 μm therebetween. The portion where the photosensitive drum 1 and the developing sleeve 4*b* face one another is the developing portion "c" for performing developing operations.

At the developing portion c, the developing sleeve 4*b* is rotationally driven in the opposite direction to the direction of rotation of the photosensitive drum 1. The two-component developing agent 4*e* within the developing container 4*a* is held on the outer circumference of the developing sleeve 4*b* by adsorption by the magnetic force of the magnetic roller 4*c* within the sleeve 4*b*, as a magnetic brush layer. The two-component developing agent is rotationally transported according to the rotation of the sleeve 4*b*, formed into a thin layer with a predetermined thickness by the developing agent coating blade 4*d*, comes into contact with the face of the photosensitive drum 1 at the developing portion c, and slides across the face of the photosensitive drum 1 as appropriate. A predetermined developing bias from the electric power source S2 is applied to the developing sleeve 4*b*.

The toner component within the developing agent 4*e* coated on the face of the rotating developing sleeve 4*b* as a thin layer and transported to the developing portion c selectively adheres to the electrostatic latent image on the photosensitive drum 1 due to the developing bias electric field, and thus is developed as a developing agent image (toner image). In the case of the present embodiment, toner adheres to the light exposed portions of the face of the photosensitive drum 1 and the electrostatic latent image is inversely developed so as to form a toner image on the surface of the photosensitive drum 1.

The developing agent thin layer on the developing sleeve 4*b* which has passed through the developing portion c is returned to the developing agent pooling portion within the developing container 4*a* by the consecutive rotations of the developing sleeve 4*b*.

In order to maintain the toner concentration of the two-component developing agent 4*e* within the developing container 4*a* within a predetermined generally-constant range, the toner concentration of the two-component developing agent 4*e* within the developing container 4*a* is detected by an unshown toner concentration sensor, for example, an optical toner concentration sensor. The toner hopper 4*g* is controlled and driven according to the detection information thereof, and the toner within the toner hopper 4*g* is supplied to the two-component developing agent 4*e* within the developing container 4*a*. The toner supplied into the two-component developing agent 4*e* is stirred by the developing agent stirring members 4*f*.

e) Transfer and fixing means: A transfer roller 5 is used as transfer means with the present embodiment. The transfer roller 5 is pressed against the photosensitive drum 1 with a predetermined pressure, and the contact nip portion thereof is the transfer portion "d". The recording medium P is supplied to this transfer portion d from an unshown sheet supplying mechanism, and at predetermined controlled timing.

The recording medium P supplied to the transfer portion d is nipped between the rotating photosensitive drum 1 an the transfer roller 5 and transported, during which a positive bias, opposite to the negative polarity which is the regular charging polarity of the toner, is applied to the transfer roller 5 from the electric power source S3, thereby sequentially performing electrostatic transfer of the toner image on the photosensitive drum 1 side onto the surface of the recording medium P being nipped and transported by the transfer portion d.

The recording medium P which has passed through the transfer portion d and received the toner image thereupon is sequentially separated from the face of the rotating photosensitive drum 1, transported to the fixing means 6 (e.g., a thermal roller fixing unit), and subjected to fixing processing of the toner image, thus being output as an image product (print or copy).

Thus, an image is formed on the recording medium P with the a) image carrying member, b) charging means, c) electrostatic latent image formation means, d) developing means, and e) transfer and fixing means, and discharged from the apparatus.

With the image formation apparatus (printer) according to the present embodiment which performs such image formation actions, a cleaner-less system, i.e., simultaneous developing and cleaning of the residual developing agent (residual toner) is performed, so a cleaning device specially for removing the residual developing agent (residual toner) of which some remains on the face of the photosensitive drum 1 following transfer of the toner image onto the recording medium P is not provided. The present embodiment is an image formation apparatus using the cleaner-less system.

The residual toner on the photosensitive drum 1 following transfer is carried to the developing portion c, over the charging portion a and exposure portion b due to the continuing rotation of the photosensitive drum 1, and simultaneous developing and cleaning (recovery) of the developing agent is performed by the developing device 4. As another method besides the residual toner recovery method according to the present embodiment, there is also a method wherein the residual toner is recovered with the transfer means and recovered with a cleaning device of the transfer means.

As noted above regarding d), the minimal distance (S-D gap) between the developing sleeve 4*b* of the developing device 4 and the photosensitive drum 1 is 350 $\mu$m, and maintaining this distance causes the magnetic brush formed on the developing sleeve 4*b* to be rubbed across the surface of the photosensitive drum 1 in a suitable manner so as to recover the residual toner at the same time as performing developing. Note that the developing device 4 is arranged such that the face of the developing sleeve 4*b* moves in the opposite direction to the direction of motion of the face of the photosensitive drum 1 at the developing portion c, i.e., the developing sleeve 4*b* and the photosensitive drum 1 both rotate in the same counterclockwise direction, so the faces thereof move in opposite directions one to another, which is advantageous for recovery.

The residual toner on the face of the photosensitive drum 1 passes through the exposure portion b, and the exposure process is performed from above the residual toner, but the amount of residual toner is small, so the effects are not great. However, the residual toner on the face of the photosensitive drum 1 following the transfer process also includes negative polarity toner at the image formation portions, positive polarity toner at the image non-formation portions, and inverse toner, which has been affected by the positive polarity of transfer such that the polarity thereof has inverted to positive polarity. Inverse toner passing through the charging portion a may result onto adhesion thereof to the charging roller 2, contaminating the charging roller 2 beyond a permissible level and causing substandard charging.

On the other hand, in order to effectively perform simultaneous developing and cleaning of the residual toner on the face of the photosensitive drum 1 with the developing device 4, there is the need for the charged polarity of the residual toner on the photosensitive drum 1 carried to the developing portion c to be the regular polarity, and also the amount of the charge thereof needs to be a charge capable of forming an electrostatic latent image on the photosensitive drum 1 with the developing device 4. In the event that there is inverse toner or improper charge amounts, the toner cannot be removed or recovered from the photosensitive drum 1 to the developing device 4, leading to substandard images.

Accordingly, with the present embodiment, a first auxiliary brush 7 serving as first developing agent (toner) charging means and a second auxiliary brush 8 serving as second developing agent charging means downstream therefrom in the rotation direction of the photosensitive drum 1 are provided downstream from the transfer portion d in the direction of rotation of the photosensitive drum 1 but upstream form the charging portion a, so as to make the residual toner on the photosensitive drum 1 uniform and to make the regular charging polarity of the residual toner all negative.

With the present embodiment, the first auxiliary brush 7 and the second auxiliary brush 8 are brush-shaped members having a suitable level of electroconductivity, disposed in contact with the face of the photosensitive drum 1. Positive (inverse to the regular polarity of the toner) voltage is applied to the first auxiliary brush 7 from an electric power source S4, and negative (regular polarity of the toner) voltage is applied to the second auxiliary brush 8 from an electric power source S5.

At a contact portion "e" between the first auxiliary brush 7 and the face of the photosensitive drum 1, of the residual toner with various types of polarity, the uncharged toner and toner charged negatively is temporarily adsorbed to the first auxiliary brush 7. There is a limit to the amount of toner this first auxiliary brush 7 can carry, so following reaching a saturated state, the toner gradually drops out and adheres to the face of the photosensitive member whereby it is carried, but at this point, the polarity of the toner is a positive polarity. Here, the distribution of the toner is made uniform.

Next, at a contact portion "f" between the second auxiliary brush 8 and the face of the photosensitive drum 1, the residual toner on the photosensitive drum 1 which passes by the second auxiliary brush 8 has the charging polarity thereof changed to all negative polarity which is the regular polarity. The toner has all been set to the positive polarity by the first auxiliary brush 7, so the process of charging the toner negatively is carried out even more effectively. Setting the charging polarity of the residual toner to the negative polarity which is the regular polarity with the second auxiliary brush 8 greatly increases the mirroring of the photosensitive drum 1 at the time of charging the face of the photosensitive drum 1 from above the residual toner at the charging portion "a" disposed further downstream, thereby preventing adhesion of the residual toner to the charging roller 2. Also, as described above, controlling the polarity of the residual toner enables recovery of the residual toner to be preformed more effectively at the developing device.

While the above described is the mechanism in operation in the steady state of the image processing apparatus according to the present embodiment, there are problems in non-steady operation states, such as upon start-up or closing down; primarily the two problems described below which have also been discussed in the description of conventional examples.

First, the toner adhering to the first and second auxiliary brushes 7 and 8 with some amount of physical force is discharged onto the photosensitive drum 1 at the time of the image formation apparatus beginning to operate. The amount of charge of such toner discharged onto the photosensitive drum 1 from the first and second auxiliary brushes 7 and 8 is not controlled by, and accordingly leads to adhesion and contamination of the charging roller 2, and results in substandard images.

Second, the first and second auxiliary brushes 7 and 8 affect the charging potential on the circumferential face of the photosensitive drum 1, so the charging potential on the photosensitive drum 1 is unstable, a predictable potential is not available, and further minute potential irregularities may occur. Particularly, in a case that contact developing is used for the developing device 4 as with the present embodiment, in the event that the face of the photosensitive drum 1 reaches the developing device 4 without being properly charged at the charging roller 2, toner may adhere to the photosensitive drum 1 depending on the potential even in the event that there is no supply of electric power to the developing device 4, or the carrier may adhere to the photosensitive member depending on the potential, leading to substandard images.

Now, the relation between adhesion of toner to the charging roller 2 and bias applied to the charging roller 2 according to the present embodiment, with regard to the first issue listed above, will be described. Applying bias to the auxiliary brushes 7 and 8 causes discharge of toner at the time of starting and ending application. Table 1 below illustrates the relation between adhesion of the toner discharged onto the photosensitive drum 1 and the bias applied to the charging roller 2 by the electric power source S1. Now, voltage at the discharge range means, in the event of using DC voltage, voltage equal to or greater than a discharge start voltage Vth, where discharge charging of the photosensitive drum is started upon applying DC voltage to the charging roller. In the event of using AC voltage, this means a voltage having an inter-peak voltage of twice or greater than the discharge start voltage Vth for DC voltage. Voltage other than the discharge range is non-discharging range voltage. With the present embodiment, the discharge start voltage Vth to the photosensitive drum 1 at the time of applying the DC voltage to the charging roller 2 is 500 V, so voltage of 500 V or greater is voltage in the discharge range. In the event of AC voltage, voltage having an inter-peak voltage of twice or greater than the discharge start voltage Vth, i.e., 1,000 V or greater, is voltage in the discharge range.

TABLE 1

| Bias from electric power source S1 | | |
|---|---|---|
| AC voltage (inter-peak voltage) | DC voltage | Contamination of charging roller 2 |
| 1,000 V (Discharge range) | 0 V | None observed |
| 400 V (Non-discharging range) | 0 V | None observed |
| 0 V | 400 V (Non-discharging range) | Observed |
| 0 V | 1,000 V (Discharge range) | Observed |
| 0 V | 0 V | Observed |

In the event that the bias applied from the electric power source S1 is AC voltage alone, and there is no DC component superimposed, in the event that the inter-peak voltage value is 1,000 V, there is temporary adhesion of the toner to the charging roller 2, but this returns to the photosensitive drum 1 after two or more rotations of the charging roller 2. Accordingly, the charging roller 2 is not soiled. Also, in the event that the inter-peak voltage value is AC 400 V, there is temporary adhesion to the charging roller 2, but this also returns to the photosensitive drum 1 after two or more rotations of the charging roller 2. However, the amount returning to the photosensitive member is not that great as compared to application of AC voltage in the discharging range.

On the other hand, the charging roller 2 was soiled in the event that only DC voltage was applied from the electric power source S1, regardless of in the discharge range or non-discharging range. Conversely, in the event that AC voltage and DC voltage are superimposed, the DC voltage is irrelevant, and there is no soiling of the charging roller in the event that the AC voltage is applied.

As described above, applying an AC voltage bias to the charging roller 2 when there is the risk of the charging roller 2 becoming soiled, prevents soiling of the charging roller 2. Soiling of the charging roller can also be suppressed when the toner charge polarity is controlled in a steady state, but particularly is effective in states wherein the amount of charge of the toner is not uniform, at starting and ending of application of bias to the auxiliary brushes 7 and 8.

Next, the relation between the bias application state to the charging roller 2 when bias is applied to the auxiliary brushes 7 and 8, and the state of the charge potential on the photosensitive drum 1, with regard to the second issue listed above, is illustrated in Table 2.

TABLE 2

| Bias from electric power source S1 | | State of charge |
|---|---|---|
| AC voltage (inter-peak voltage) | DC voltage | potential on photosensitive drum 1 |
| 1,000 V (Discharge range) | 0 V | Stabilizes at 0 V |
| 400 V (Non-discharging range) | 0 V | Unstable |
| 0 V | 400 V (Non-discharging range) | Unstable |
| 0 V | 1,000 V (Discharge | Stabilizes at 500 V |

TABLE 2-continued

| Bias from electric power source S1 | | State of charge |
|---|---|---|
| AC voltage (inter-peak voltage) | DC voltage | potential on photosensitive drum 1 |
| | range) | |
| 0 V | 0 V | Unstable |

From Table 2, it can be understand that the charging potential on the face of the photosensitive drum 1 is not stable in the event that voltage is not applied to the charging roller 2 or in the event that the applied voltage is an AC voltage in the non-discharging range or lower or a DC voltage. In the event of superimposing AC voltage and DC voltage, the potential on the photosensitive drum 1 did not stabilize as long as both were in the non-discharging range. This means that the surface potential stabilizes as long as at least one or the other of the Dc voltage and AC voltage is voltage in the discharge range.

The first and second auxiliary brushes 7 and 8 affect the charging potential on the photosensitive drum 1, so the charging potential on the photosensitive drum 1 is unstable, a predictable potential is not available, and further minute potential irregularities may occur. Accordingly, in the event that voltage in the non-discharging range is applied to the charging roller 2, the potential on the photosensitive drum 1 following passing over the charging roller 2 is also unstable.

In the event of applying DC voltage in the discharge range, the potential on the photosensitive drum 1 stabilizes at the differential potential between the applied bias and the discharge starting voltage, and in the event that AC voltage with an inter-peak voltage in the discharge range is applied, the potential on the photosensitive drum 1 stabilizes at the DC voltage component value, and accordingly, the potential state becomes predictable.

Accordingly, applying discharge range bias to the charging roller 2 first adjusts the charging potential from the charging roller 2 to the photosensitive drum 1, resulting in a stabilized state. Accordingly, the photosensitive drum 1 can be prevented from approaching the developing device 4 without suitable charging processing, so even in the event that there is no supply of electric power source to the developing device 4 for example, phenomena wherein the developing agent adheres depending on the potential of the photosensitive drum 1 or wherein the carrier adheres depending on the potential of the photosensitive drum 1 can be prevented.

From the above, at the time of starting the operations of the image formation apparatus, the AC voltage of the charging roller 2 should be first applied, and at the time of ending operations of the image formation apparatus, the timing of ending the AC voltage of the charging roller 2 should be after ending the image formation wherein there is the risk of toner being discharged form the auxiliary brushes 7 and 8. Also, in the event that the inter-peak voltage of the AC voltage is a discharge range voltage, the potential on the photosensitive drum can be stabilized.

Figure 3:
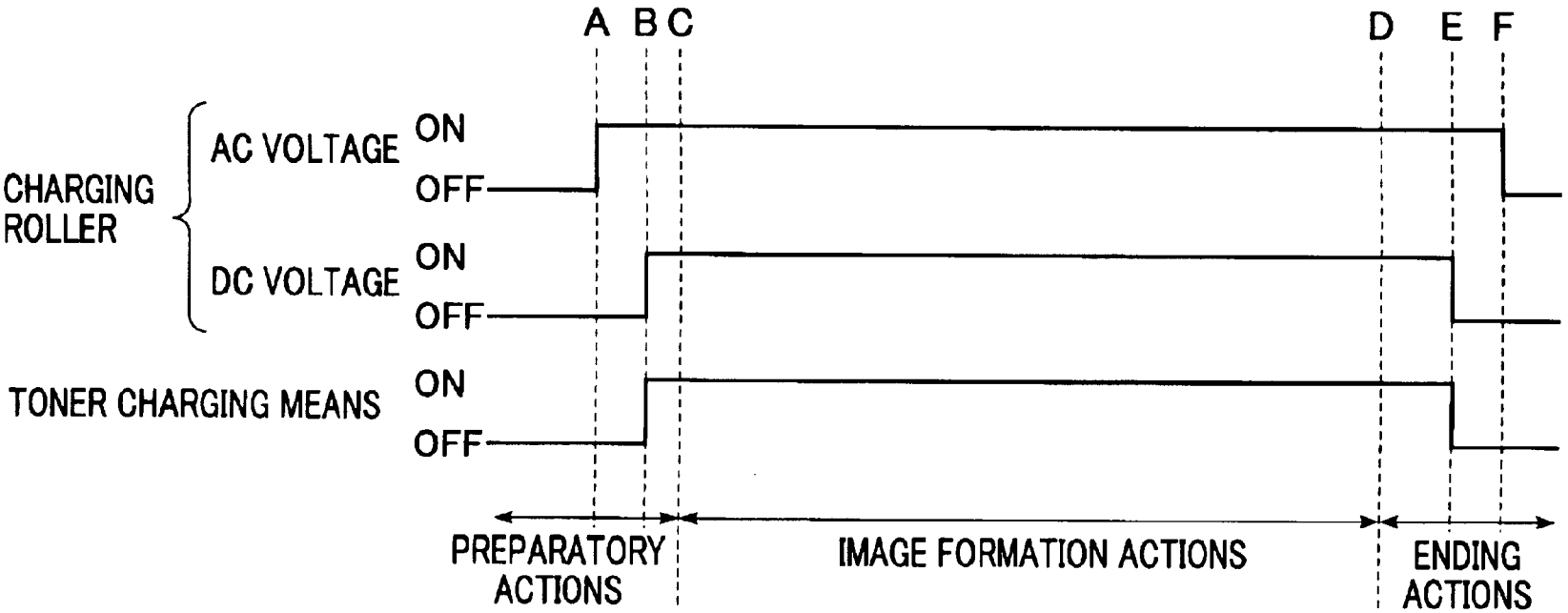
FIG. 3 is a timing chart illustrating an example of the bias application timing for the charging means and developing agent charge control means according to the present invention.

FIG. 3 illustrates the timing for applying bias to the charging roller 2 and the timing for applying bias to the auxiliary brushes 7 and 8, according to the present embodiment. FIG. 3 shows the timing at which certain points on the surface of the photosensitive drum 1 pass over the charging roller 2. Thus, it should be understood that this is different from timing in absolute time.

Reference characters A through F in the drawing illustrate points on the photosensitive drum 1. The point A at which at least the AC voltage of the charging roller is applied is before the point B where the auxiliary brush bias is applied. With the present embodiment, the point at which the charging DC voltage is applied is the same as with the auxiliary brushes 7 and 8, but this does not necessarily have to be the same as with the auxiliary brushes 7 and 8. After point B, from point C to point D is a printing operation section, where the system is in a steady state as described above. From point D on is the stopping operation, wherein the point F, where at least the charging AC voltage ends, is after the point E on the photosensitive drum 1 where the bias applied to the auxiliary brushes 7 and 8 ends. Here as well, the point where the application of the charging DC voltage ends does not necessarily have to be simultaneous with the auxiliary brushes 7 and 8 as shown in the drawing. The stopping of the rotations of the photosensitive drum 1 is point F or later.

That is, as shown in FIG. 3, the AC bias is first applied to the charging roller 2 before starting the series of image formation operations for forming an electrostatic latent image on the photosensitive drum 1 and forming an image on the recording medium P as described above, following which the DC voltage to the charging roller 2 and the bias to the auxiliary brushes 7 and 8 is applied, and following the image formation operations ending, application of the DC voltage to the charging roller 2 and the bias to the auxiliary brushes 7 and 8 ends, and finally, application of the AC bias ends. In other words, application of the AC bias starts to the charging roller before the portion on the photosensitive drum where application of voltage to the auxiliary brushes has started reaches the position of contact between the photosensitive drum and the charging roller, and application of the AC bias to the charging roller ends after the portion on the photosensitive drum where application of voltage to the auxiliary brushes has ended reaches the position of contact between the photosensitive drum and the charging roller. Thus, soiling of the charging roller 2 due to discharge of toner from the auxiliary brushes 7 and 8 is prevented, and also, charging of the photosensitive drum 1 can be stabilized since the bias is in the discharging range or higher.

In the event of applying superimposed DC voltage and AC voltage to the charging roller, applying the AC voltage first and subsequently applying the DC voltage as shown in FIG. 3 facilitates control of the surface potential of the photosensitive drum at the time of starting charging. The reason is that the surface potential stabilizes at the applied DC voltage value. For example, in the event that voltage is to be applied to the photosensitive drum with a gentle potential incline, AC voltage should be applied first, and then DC voltage can be applied with a gentle potential incline. On the other hand, applying AC voltage after applying DC voltage makes control of the amplitude of the AC voltage difficult, so the surface potential of the photosensitive drum at the time of starting charging cannot be readily known. Also, due to the same reason, at the time of ending application of voltage, ending application of the DC voltage first and then ending application of the AC voltage facilitates control of the surface potential of the photosensitive drum 1.

Summarizing the above, with an image formation apparatus, applying AC voltage to the charging means before applying bias to the auxiliary brushes at the time of starting image formation, and ending application of AC voltage to the charging means after ending application of bias to the auxiliary brushes at the time of ending image formation, enables substandard images due to adhesion of developing agent to the charging means and substandard charging of the image carrying member, to be prevented.

It should be noted that the dimensions, materials, shapes, and relative positions and the like of the components of the image formation apparatus described above are by no means restricted to those described here, unless specifically stated.

While the present embodiment has been described with reference to an example wherein the residual toner is recovered in a developing device, the residual toner may be collected by the transfer roller, as a different method.

While the present embodiment has been described with reference to an example wherein the toner image on the image carrying member is directly transferred to a recording medium, an arrangement may be applied to the present invention wherein an intermediate transfer medium is used.

Also, it is needless to say that the present invention can be applied to color image formation apparatuses forming color images of multiple colors using multiple developing devices, or in-line type image formation devices with multiple image carrying members.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image formation apparatus comprising:

an image carrying member;

charging means for being applied with a voltage including an AC voltage component and coming into contact with a surface of said image carrying member so as to charge said image carrying member;

developing means for visualizing an electrostatic latent image formed on said image carrying member into a developing agent image with a developing agent;

transfer means for transferring the developing agent image onto a transfer member; and developing agent charging means for charging developing agent remaining on said image carrying member following the transfer, wherein said developing agent charging means is upstream from said charging means and downstream from said transfer member in a direction of motion of said image carrying member, wherein application of the AC voltage to said charging means is started before a portion on said image carrying member, where application of voltage to said developing agent charging means has started, reaches a position of coming into contact with said charging means, and wherein application of the AC voltage to said charging means is ended after a portion on said image carrying member, where application of voltage to said developing agent charging means has ended, reaches a position of coming into contact with said charging means.

2. An image formation apparatus according to claim 1, wherein the AC voltage has an inter-peak voltage of twice or more the discharge starting voltage between said image carrying member and said charging means.

3. An image formation apparatus according to claim 1, wherein said developing agent charging means comprises electroconductive brush-shaped members coming into contact with said image carrying member.

4. An image formation apparatus according to claim 1, wherein said developing means performs contact developing, and wherein said developing agent charging means comes into contact with said image carrying member.

5. An image formation apparatus according to claim 1, wherein said developing agent is a two-component developing agent of toner and magnetic carrier.

6. An image formation apparatus according to claim 1, wherein said developing agent carrying means comprises:

first developing agent charging means situated downstream from said transfer means and upstream from said charging means in the direction of motion of said image carrying member; and second developing agent charging means situated downstream from said first developing agent charging means and upstream from said charging means in the direction of motion of said image carrying member, and wherein said first developing agent charging means applies voltage of inverse polarity to a regular polarity of the developing agent, and said second developing agent charging means applies the regular polarity voltage of the developing agent.

7. An image formation apparatus according to claim 1, wherein the developing agent remaining on said image carrying member following transfer is collected by said developing means using an electric field.

8. An image formation apparatus according to claim 1, wherein the developing agent remaining on said image carrying member following transfer is collected by said transfer means using an electric field.

9. An image formation apparatus according to claim 1, wherein a DC voltage and the AC voltage are superimposed on said charging means, with the order of starting application of voltage being in the order of the AC voltage and then the DC voltage, and with the order of ending application of voltage being in the order of DC voltage and then AC voltage.

10. An image formation apparatus comprising:

an image carrying member;

charging means for being applied with a voltage including an AC voltage component and coming into contact with a surface of said image carrying member so as to charge said image carrying member;

developing means for visualizing an electrostatic latent image formed on said image carrying member into a developing agent image with a developing agent;

transfer means for transferring said developing agent image onto a transfer member; and developing agent charging means for charging developing agent remaining on said image carrying member following the transfer, wherein said developing agent charging means is upstream from said charging means and downstream from said transfer means in the direction of motion of said image carrying member, and wherein application of the AC voltage said charging means is ended after a portion on said image carrying member, where application of voltage to said developing agent charging means has ended, reaches a position of coming into contact with said charging means.

11. An image formation apparatus according to claim 10, wherein the AC voltage has an inter-peak voltage of twice or more a discharge starting voltage between said image carrying member and said charging means.

12. An image formation apparatus according to claim 10, wherein a DC voltage and the AC voltage are superimposed on said charging means, with an order of ending application of voltage being in the order of the DC voltage and then the AC voltage.

<page_rtocr_ ="0" />

US 6,996,355 B2
15 16
* * * * *

UNITED STATES PATENT AND TRADEMARK OFFICE

CERTIFICATE OF CORRECTION

PATENT NO. : 6,996,355 B2
APPLICATION NO. : 10/685465
DATED : February 7, 2006
INVENTOR(S) : Yasunari Watanabe It is certified that error appears in the above-identified patent and that said Letters Patent is hereby corrected as shown below:

ON THE TITLE PAGE:

IN THE ABSTRACT, ITEM (57):

Line 7, “drum” should read --drum,--;
Line 8, “started” should read --started,--;
Line 12, “drum” should read --drum,--; and
Line 13, “ended” should read --ended,--.

COLUMN 2:

Line 57, “form” should read --from--; and
Line 58, “form” should read --from--.

COLUMN 7:

Line 17, “an” should read --and--.

COLUMN 14:

Line 54, “voltage” should read --voltage to--.

Signed and Sealed this

Twenty-second Day of August, 2006

JON W. DUDAS
*Director of the United States Patent and Trademark Office*